US007553103B2

(12) United States Patent
Jameson et al.

(10) Patent No.: US 7,553,103 B2
(45) Date of Patent: Jun. 30, 2009

(54) DELINEATOR MOUNTING SYSTEM

(75) Inventors: Matt Jameson, Eastland, TX (US); Darrell Heald, Georgetown, TX (US); Ronald Riker, Brownwood, TX (US)

(73) Assignee: Caminoverde II, L.P., Hutto, TX (US)

( * ) Notice: Subject to any disclaimer, the term of this patent is extended or adjusted under 35 U.S.C. 154(b) by 0 days.

(21) Appl. No.: 11/684,612

(22) Filed: Mar. 10, 2007

(65) Prior Publication Data

US 2008/0219763 A1 Sep. 11, 2008

(51) Int. Cl.
*E01F 9/019* (2006.01)

(52) U.S. Cl. ..... 404/9; 116/63 R; 40/607.01; 40/612

(58) Field of Classification Search ..... 404/9, 404/10; 116/63 R, 63 P; 40/606.01, 607.01, 40/608, 607.02, 607.03, 607.06, 607.09, 40/607.1, 612

See application file for complete search history.

(56) References Cited

U.S. PATENT DOCUMENTS

| | | | | | |
|---|---|---|---|---|---|
| 1,726,817 | A | | 9/1929 | Franklin | |
| 2,719,214 | A | | 9/1955 | Potter | |
| 3,119,588 | A | * | 1/1964 | Keats | 248/158 |
| 3,564,984 | A | * | 2/1971 | Alexander | 359/551 |
| 4,140,418 | A | * | 2/1979 | Holley | 404/11 |
| 4,596,489 | A | * | 6/1986 | Mariol et al. | 404/10 |
| 4,611,949 | A | | 9/1986 | Schmanski | |
| 4,636,109 | A | | 1/1987 | Clausen et al. | |
| 5,040,478 | A | | 8/1991 | Hughes | |
| 5,197,819 | A | * | 3/1993 | Hughes | 404/13 |
| 5,199,814 | A | * | 4/1993 | Clark et al. | 404/10 |
| 5,207,175 | A | * | 5/1993 | Andonian | 116/209 |
| 5,231,392 | A | * | 7/1993 | Gust | 340/932.2 |
| 5,439,311 | A | * | 8/1995 | Hughes, Jr. | 404/10 |
| 5,470,170 | A | * | 11/1995 | Lindner | 404/9 |
| 5,703,577 | A | * | 12/1997 | Carter | 340/908 |
| 5,911,523 | A | * | 6/1999 | Burchart | 40/406 |
| 6,036,400 | A | * | 3/2000 | Clark | 404/9 |
| 6,109,820 | A | * | 8/2000 | Hughes, Sr. | 404/10 |
| 6,267,529 | B1 | * | 7/2001 | Mudryk et al. | 404/10 |
| 6,318,011 | B1 | * | 11/2001 | McCudden | 40/607.1 |
| 6,517,280 | B2 | * | 2/2003 | Carter | 404/6 |
| 6,530,166 | B1 | * | 3/2003 | Garfinkle et al. | 40/606.14 |
| 6,619,629 | B1 | * | 9/2003 | Boswell | 256/13.1 |
| 6,739,567 | B1 | * | 5/2004 | Curtis | 248/548 |
| 7,003,919 | B2 | | 2/2006 | Riker | |
| 7,077,599 | B1 | * | 7/2006 | Hughes, Jr. | 404/10 |

* cited by examiner

*Primary Examiner*—Gary S Hartmann
(74) *Attorney, Agent, or Firm*—Daniel V. Thompson

(57) ABSTRACT

Traffic delineators may be surface mounted on either level or sloped surfaces. A delineator mounting system adapted for the surface-mounting of a delineator includes a base having a generally-planar bottom surface, a cavity in the base, a top surface, and walls forming an aperture through the top surface to the cavity. A coupling has legs, with at least one leg being interfitted with the cavity of the base, and at least one other leg extending through the aperture of the base. A delineator is fastened to the leg of the coupling extending through the aperture of the base.

4 Claims, 6 Drawing Sheets

DELINEATOR MOUNTING SYSTEM

BACKGROUND OF INVENTION

The present invention relates in general to traffic delineators. More specifically, but without restriction to the particular use which is shown and described, this invention relates to delineators that may be surface mounted on either level or sloped surfaces.

A traffic delineator is a conventional device used upon many highways to indicate to the driver the edge of the road or, in the alternative, an upcoming division or revision in traffic lanes. In a design of such marking posts or traffic delineators it is desirable for the post to be constructed in a manner which is inexpensive and provides for a quick and simple installation. The post should also be able to withstand many impacts from the bumpers of high speed vehicles without sustaining damage or destroying the post and without pulling the post out of or from connection with the ground/pavement.

The ease and speed of installation is particularly important in view of the large number of parking posts or traffic delineators which are used along the highways and expressways and, in fact, frequently the installation of the posts is performed when the installer is exposed to motor vehicle traffic. For these reasons, it is also desirable for the post to be designed for quick and conventional replacement in the event it is destroyed or no longer usable. Further, the post must be installed in a manner by which the post may not be easily damaged or removed by persons walking along the roadway and/or during the installation process.

SUMMARY OF THE INVENTION

A delineator mounting system adapted for the surface-mounting of a delineator includes a base having a generally-planar bottom surface, a cavity in the base, a top surface, and walls forming an aperture through the top surface to the cavity. A coupling has legs, with at least one leg being interfitted with the cavity of the base, and at least one other leg extending through the aperture of the base. A delineator is fastened to the leg of the coupling extending through the aperture of the base.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

Figure 1:
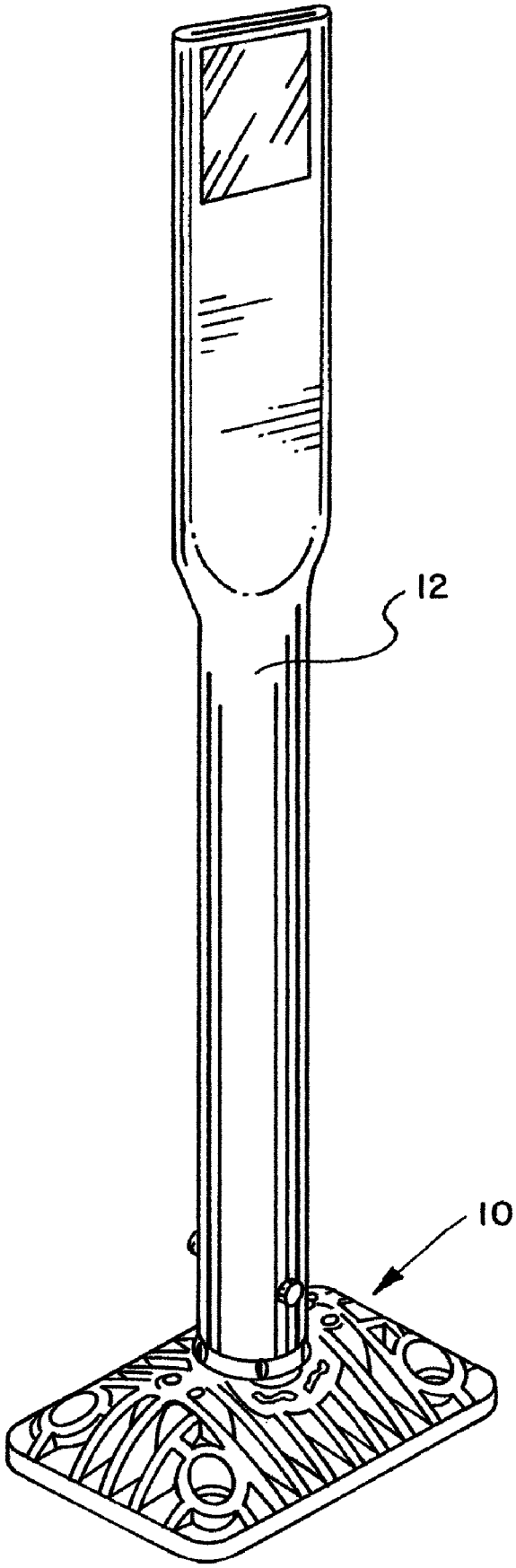
FIG. 1 is a perspective view of the delineator mounting system of the present invention along with a delineator.
Figure 2:
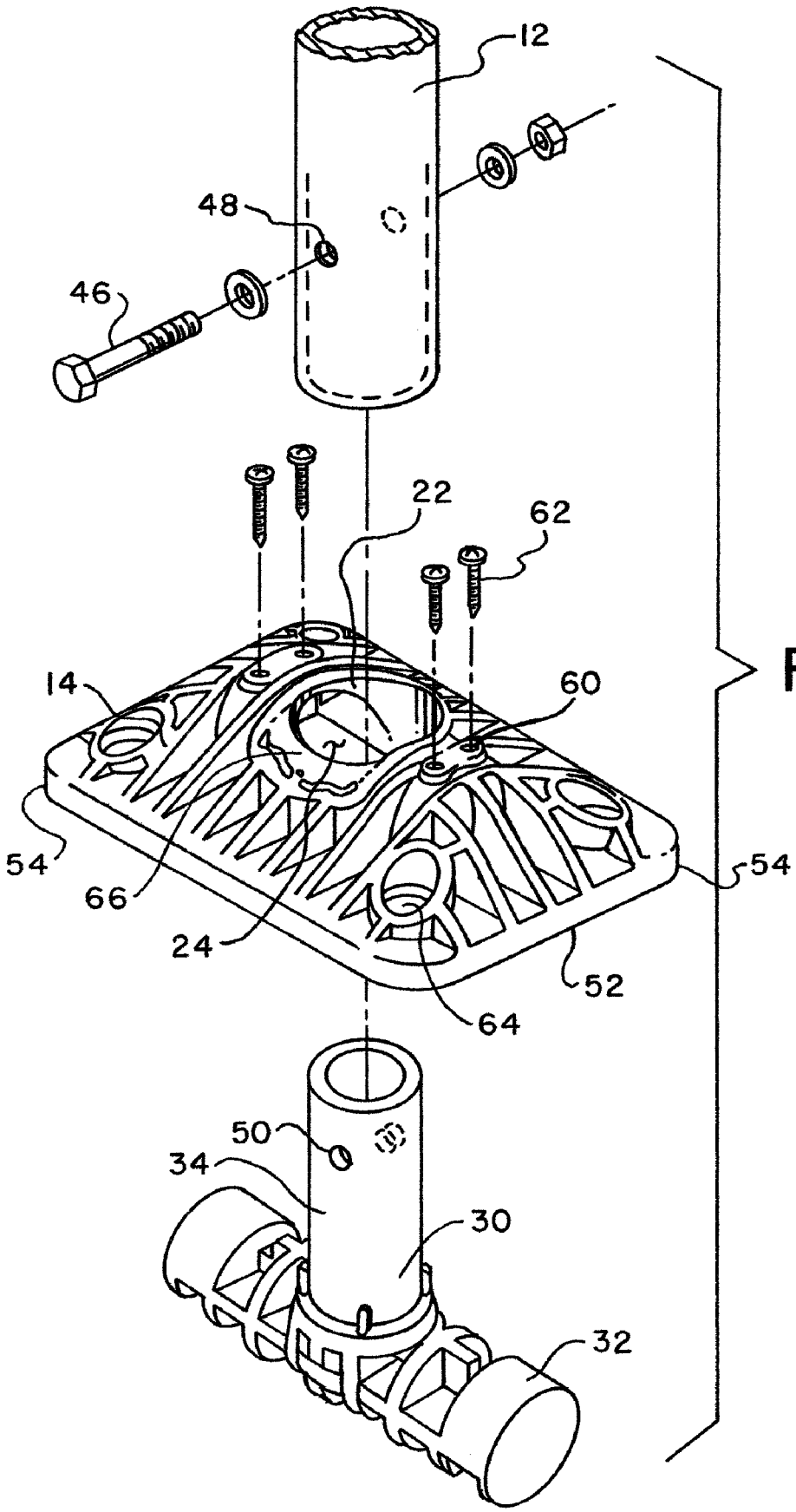
FIG. 2 is an exploded perspective view of the delineator mounting system of FIG. 1.
Figure 3:
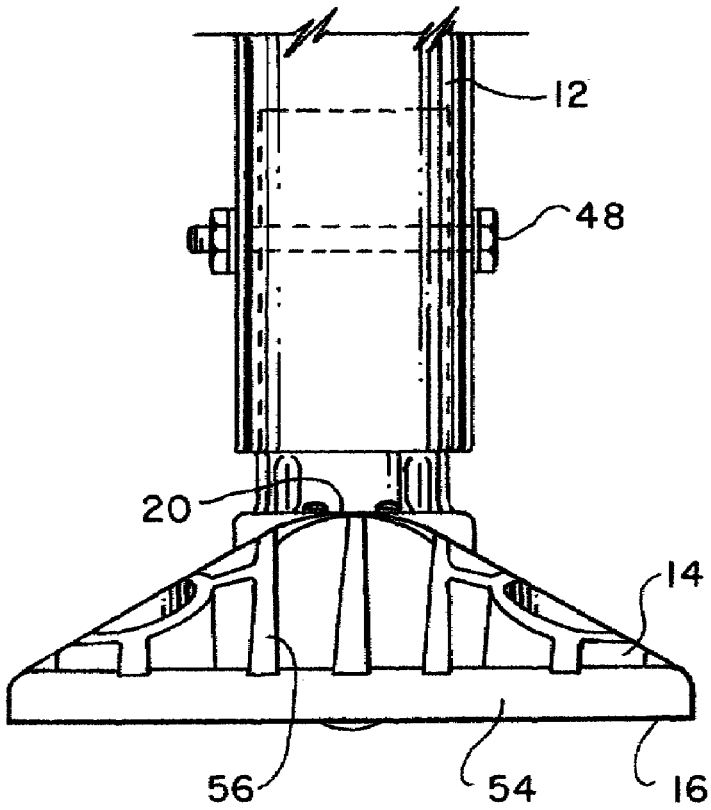
FIG. 3 is a side view of the delineator mounting system of FIG. 1.
Figure 4:
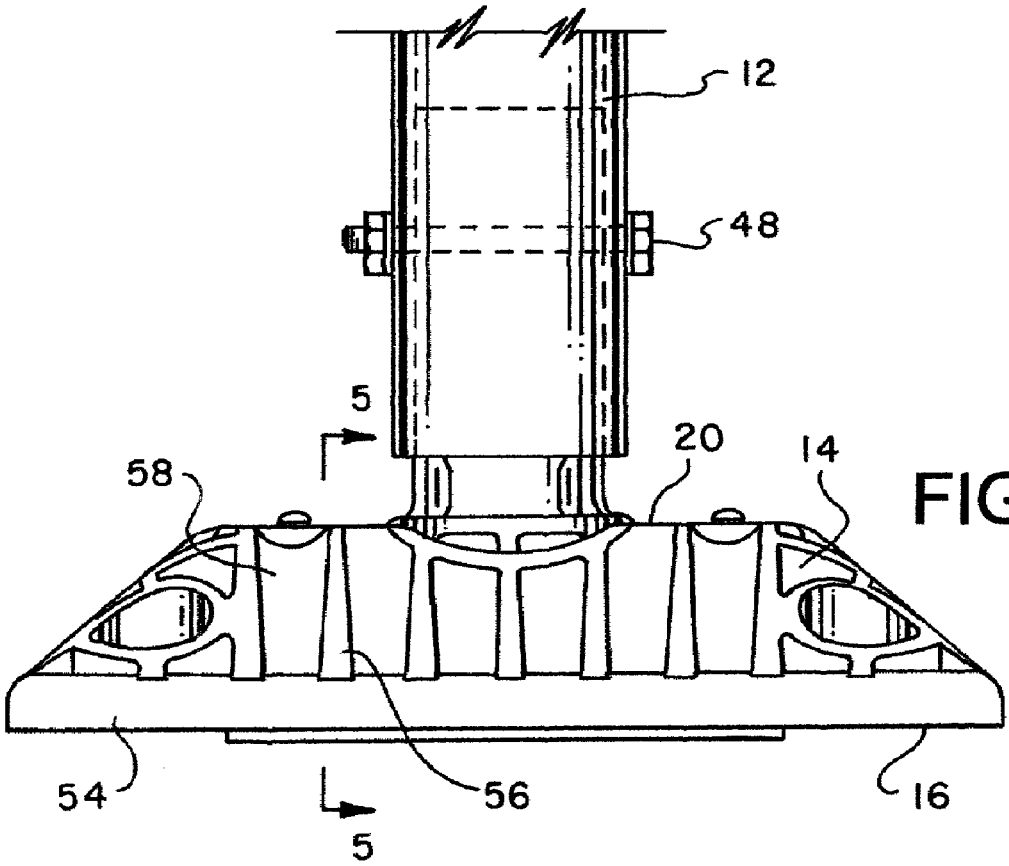
FIG. 4 is a front view of the delineator mounting system of FIG. 1.
Figure 5:
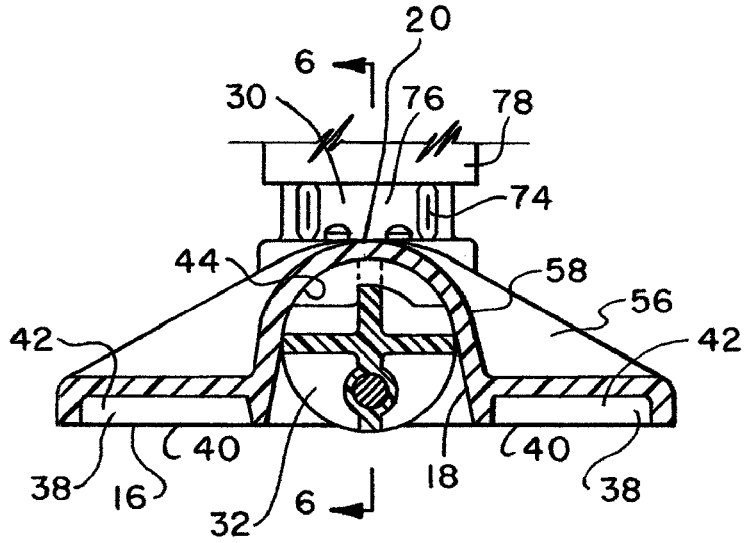
FIG. 5 is a sectional view taken along lines 5-5 of FIG. 4.
Figure 6:
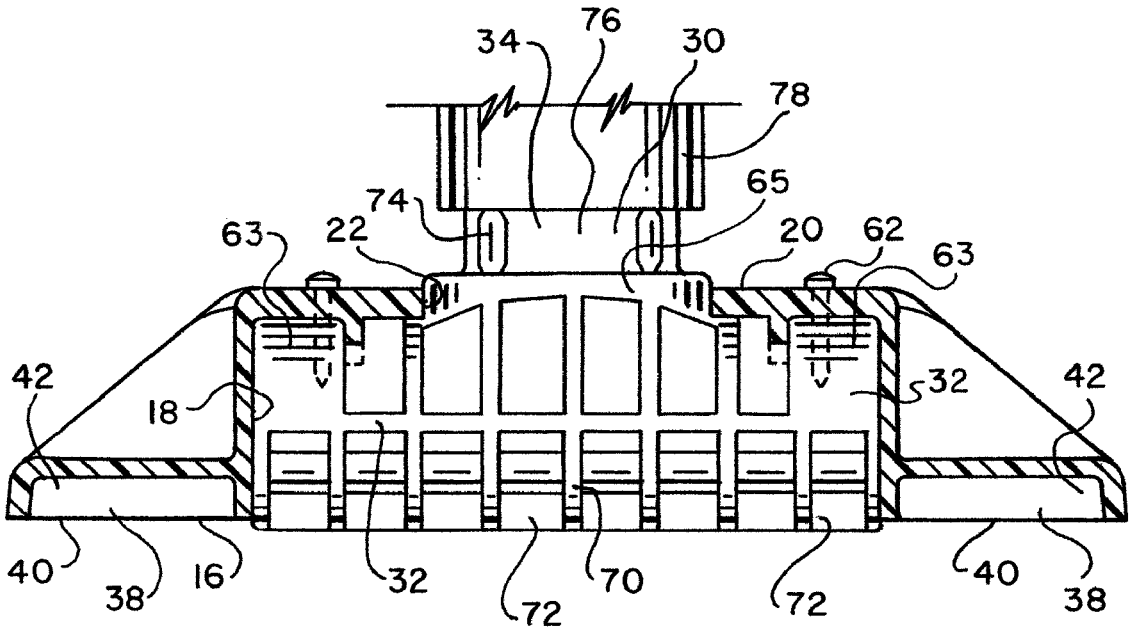
FIG. 6 is a sectional view taken along lines 6-6 of FIG. 5.
Figure 7:
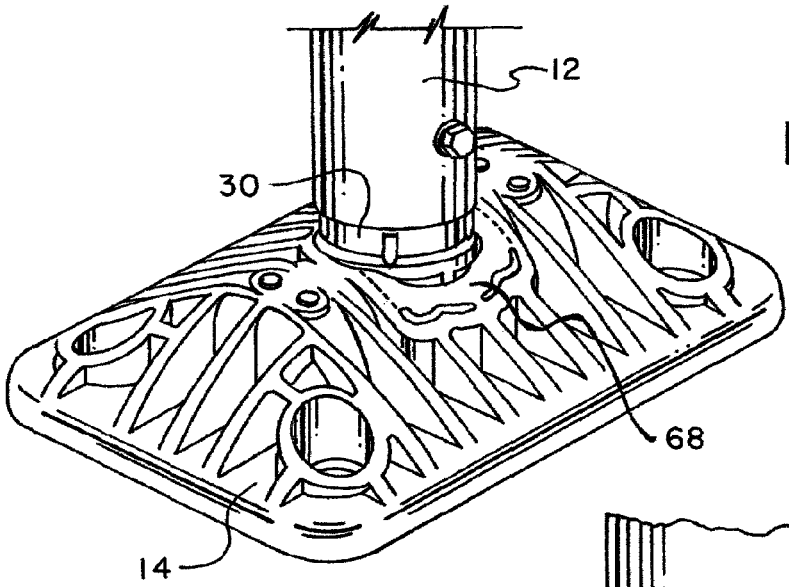
FIG. 7 is an enlarged perspective view of the top of the base.
Figure 8:
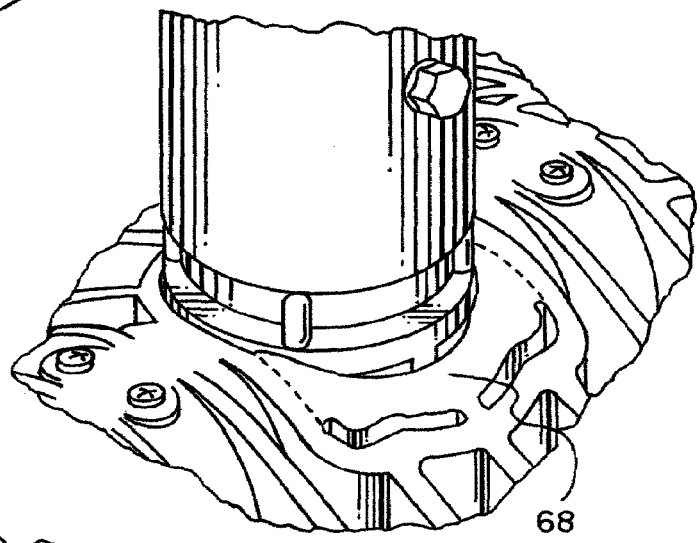
FIG. 8 is a close up perspective view of the central aperture of the base of FIG. 7.
Figure 9:
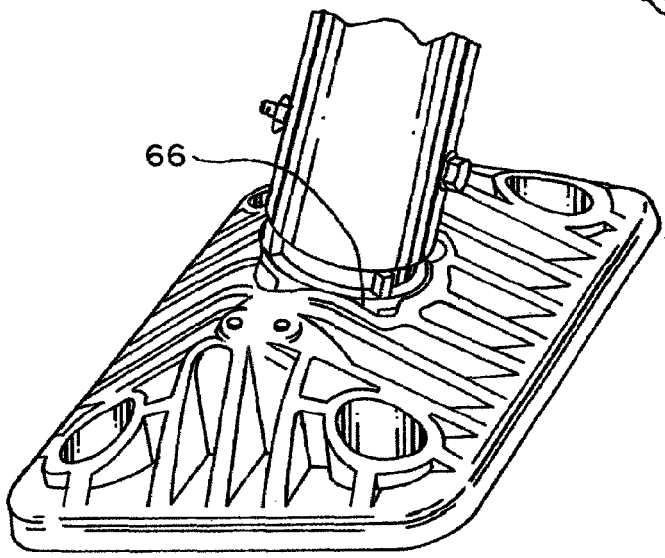
FIG. 9 is an enlarged perspective view of the top of the base with the cut-away section removed and the coupling rotated away from perpendicular to the base.

Referring initially to FIG. 1, in its simplest aspect the invention provides a delineator mounting system 10 that is adapted for the surface-mounting of a delineator 12. As shown in FIGS. 2-6, the components of the delineator mounting system include a base 14. Base 14 has a generally-planar bottom surface 16. A cavity 18 is provided in the base, as best shown in FIGS. 5 and 6. The base 14 includes a top surface 20, and walls 22 (FIG. 2) forming an aperture 24 through the top surface 20 to the cavity 18.

A coupling 30 has two legs 32,34. At least one leg, leg 32, is interfitted with the cavity 18 of the base 14. At least one other leg, leg 34, extends through the aperture 24 of the base 14.

The delineator 12 is fastened to the leg 34 of the coupling 30 extending through the aperture 24 of the base 14.

In one example of a delineator mounting system 10, the bottom surface 16 of the base 14 is partially defined by a multiplicity of adhesive retention ribs 38 having planar bottoms 40 and spaced sides 42 to form adhesive retention cavities. When adhesive is used to fix the delineator mounting system to the surface, the adhesive retention cavities provide additional surface area for the adhesive, thereby enhancing the security of the connection.

Optionally, base 14 can be provided with a cylindrical interior wall 44 (FIG. 5) forming the cavity 18 in the base 14. In this configuration, the coupling 30 has a cylindrical horizontal leg 32, and the cavity 18 in the base 14 is cylindrical and snugly interfitted with leg 32.

Vertical leg 34 can also be cylindrical to connect to a cylindrical delineator 12 by way of a through-bolt 46 and through-holes 48 and 50. The direction faced by delineator 12 can be modified by drilling new through-holes 48 in the field, as desired.

The base 14 has a continuous side wall 52 defining a generally-rectangular shape with rounded corners 54. The base top surface 20 is generally-pyramidal in shape, and defined by buttress ribs 56 extending from the side wall 52 to a cylindrical exterior wall 58 of the cylindrical cavity 18.

It may be desirable to provide walls defining a plurality of small fastener through-holes 60 extending through the cylindrical exterior wall 58 to the cylindrical interior wall 44. These permit the use of small fasteners 62 to fix the coupling 30 to the base 14, particularly when the coupling is arranged at an angle other than perpendicular to the base, as described below. In this arrangement, small fasteners 62 extend through the small fastener through-holes 60 from the top surface 20 into end portions 63 (FIG. 6) of the leg 32 interfitted with the cavity 18 of the base 14.

The base 14 can also be made with walls defining a plurality of large fastener through-holes 64 extending through the base 14 from the top surface 20 to the bottom surface 18. These through-holes 64 accommodate fasteners (not shown) for fixing the delineator mounting system to the surface when adhesive-mounting is not used. Where adhesive is used, adhesive flows into the through-holes 64 for added connection strength.

In one preferred configuration, the aperture 24 is centrally-located in the base top surface 20 and circular to snugly interfit with a cylindrical vertical leg 34 of the coupling 30. Central aperture 24 in this configuration automatically mounts coupling 30 such that delineator 12 is perpendicular to base bottom surface 18, so that when base bottom surface 18 is horizontal, delineator 12 is vertical. It may be desirable to provide that the vertical leg 34 extends perpendicularly from a medial portion 65 (FIG. 6) of the horizontal leg 32 through the central aperture 24 of the base 14.

Figure 10:
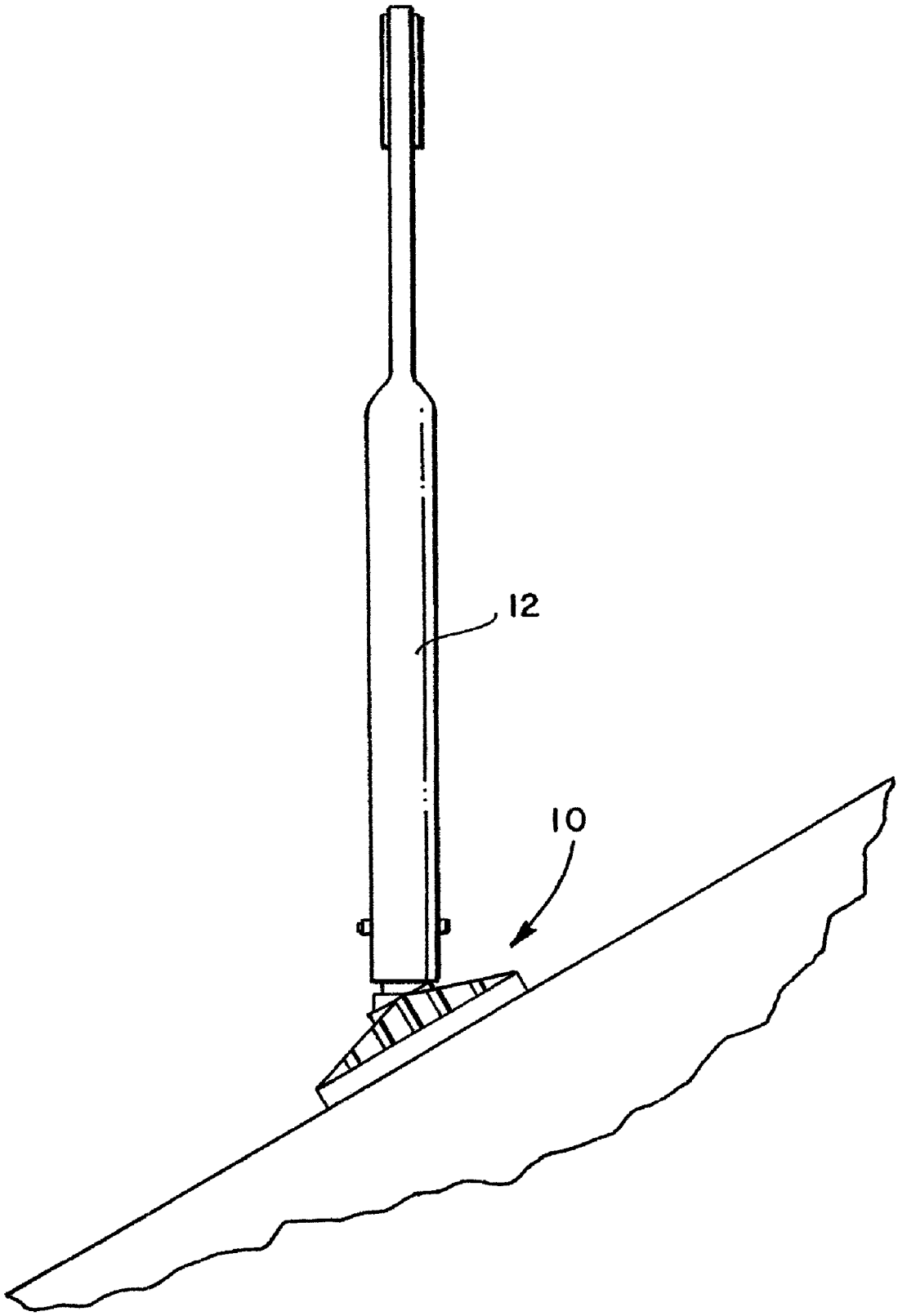
FIG. 10 is a side view of the delineator mounting system and delineator of FIG. 9 installed on a sloped surface.

Referring now in addition to FIGS. 6-9, for sloped surfaces, a portion 66 (FIG. 9) of the central aperture 24 is formed by a cut-away section 68, with the cut-away section 68 being removable to transform the central aperture in shape from circular to semi-capsular in shape. This permits about 30 degrees of rotary motion of leg 32 in cavity 18 and concomitant pivoting motion of leg 34, such that delineator 12 will be mounted at an angle that is not a right angle to base 14. As shown in FIG. 10, this permits the mounting of a vertical delineator on a sloped surface.

A superior coupling 30 will include a horizontal leg medial portion 70 with a plurality of adhesive engagement ribs 72. Ribs 72 may also include apertures (not shown) for enhanced adhesive engagement.

A plurality of stop bumps 74 may be arrayed on a lower portion 76 of the vertical leg 34. In this instance, the delineator 12 is removably fastened to the vertical leg 34 of the coupling 30, and with an end 78 of the delineator abutting the stop bumps 74.

The base 14 will typically be molded from a strong and rigid polyethylene. In contrast, it may be desirable to mold coupling 30 from of a flexible polyurethane thermoplastic elastomer, such that a delineator will deflect and return to position when struck by a vehicle.

It will be understood that each of the elements described above, or two or more together, may also find a useful application in other types of constructions differing from the type described above.

While the invention has been illustrated and described as embodied in a particular delineator mounting system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A delineator mounting system adapted for the surface-mounting of a delineator, comprising:

a base having a generally-planar bottom surface, a top surface, and a cavity in the base located between the top and bottom surfaces, with walls in the base forming an aperture through the top surface to the cavity;

a coupling with legs, at least one leg being interfitted with the cavity of the base, at least one other leg extending through the aperture of the base;

the cavity being sized more largely than the aperture to capture the coupling within the base;

a delineator fastened to the leg of the coupling extending through the aperture of the base;

with the aperture being centrally-located and circular, and the cavity being cylindrical; and with the aperture being centrally-located and circular, with a portion of the walls forming the central aperture being formed by a cut-away section, and with the cut-away section being removable to transform the central aperture from circular to semi-capsular in shape.

2. A delineator mounting system adapted for the surface-mounting of a delineator, comprising:

a base having a generally-planar bottom surface, a cavity in the base, a top surface, walls forming an aperture through the top surface to the cavity;

a coupling with legs, at least one leg being interfitted with the cavity of the base, at least one other leg extending through the aperture of the base;

a delineator fastened to the leg of the coupling extending through the aperture of the base;

with the coupling having cylindrical vertical and horizontal legs, and the cavity in the base being cylindrical;

with the horizontal leg being snugly interfitted with the cylindrical cavity of the base, and the vertical leg extending perpendicularly from a medial portion of the horizontal leg through the central aperture of the base; and with the horizontal leg medial portion including a plurality of adhesive engagement ribs.

3. A delineator mounting system adapted for the surface-mounting of a delineator, comprising:

a base having a generally-planar bottom surface, a cavity in the base, a top surface, walls forming an aperture through the top surface to the cavity;

a coupling with legs, at least one leg being interfitted with the cavity of the base, at least one other leg extending through the aperture of the base;

a delineator fastened to the leg of the coupling extending through the aperture of the base;

with the coupling having cylindrical vertical and horizontal legs, and the cavity in the base being cylindrical;

with the horizontal leg being snugly interfitted with the cylindrical cavity of the base, and the vertical leg extending perpendicularly from a medial portion of the horizontal leg through the central aperture of the base;

with a plurality of stop bumps arrayed on a lower portion of the vertical leg and with the delineator removably fastened to the vertical leg of the coupling, and with an end of the delineator abutting the stop bumps.

4. A delineator mounting system adapted for the surface-mounting of a delineator, comprising:

a base having a generally-planar bottom surface, the bottom surface partially defined by adhesive retention ribs having planar bottoms and spaced sides to form adhesive retention cavities, a cylindrical interior wall forming a cylindrical cavity in the base, a continuous side wall defining a generally-rectangular shape with rounded corners, a generally-pyramidal top surface defined by buttress ribs extending from the side wall to a cylindrical exterior wall of the cylindrical cavity, walls defining a plurality of large fastener through-holes extending through the base from the top surface to the bottom surface, a centrally-located circular aperture through the top surface to the cylindrical cavity, walls defining a plurality of small fastener through-holes extending through the cylindrical exterior wall to the cylindrical interior wall, a portion of the central aperture being formed by a cut-away section, with the cut-away section being removable to transform the central aperture from circular to semi-capsular in shape;

a coupling with cylindrical vertical and horizontal legs, the coupling being formed of a flexible polyurethane thermoplastic elastomer, the horizontal leg being snugly interfitted with the cylindrical cavity of the base, the vertical leg extending perpendicularly from a medial portion of the horizontal leg through the central aperture of the base, small fasteners extending through the small fastener through-holes from the top surface into end portions of the horizontal leg, the horizontal leg medial portion including a plurality of adhesive engagement ribs, a plurality of stop bumps arrayed on a lower portion of the vertical leg; and a delineator removably fastened to the vertical leg of the coupling, with an end of the delineator abutting the stop bumps.

* * * * *